US005830086A

United States Patent [19]

Hayashi et al.

[11] Patent Number: 5,830,086

[45] Date of Patent: Nov. 3, 1998

[54] MULTI-PIECE SOLID GOLF BALL

[75] Inventors: Junji Hayashi; Hisashi Yamagishi; Hiroshi Higuchi, all of Chichibu, Japan

[73] Assignee: Bridgestone Sports Co., Ltd., Tokyo, Japan

[21] Appl. No.: 856,235

[22] Filed: May 14, 1997

[30] Foreign Application Priority Data

May 14, 1996 [JP] Japan ..... 8-143735

[51] Int. Cl.[6] ..... A63B 37/06; A63B 37/12

[52] U.S. Cl. ..... 473/376; 473/378

[58] Field of Search ..... 473/376, 378, 473/373, 361, 364, 370

[56] References Cited

U.S. PATENT DOCUMENTS 5,725,442 3/1998 Higuchi et al. ..... 473/376

5,733,205 3/1998 Higuchi et al. ..... 473/376

*Primary Examiner*—George J. Marlo

*Attorney, Agent, or Firm*—Sughrue, Mion, Zinn, Macpeak & Seas, PLLC

[57] ABSTRACT

In a multi-piece solid golf ball comprising a multiple solid core including an inner sphere and at least one layer surrounding the inner sphere and a cover consisting of inner and outer cover layers, the inner sphere experiences a distortion of 3.5–10 mm under a load of 100 kg, the surrounding layer has a highest Shore D hardness of at least 60, the inner cover layer has a Shore D hardness of up to 58, and the outer cover layer has a Shore D hardness of at least 60. The ball presents soft pleasant feel when hit with any club from a driver to a putter and its flight performance is less dependent on head speed.

12 Claims, 1 Drawing Sheet

MULTI-PIECE SOLID GOLF BALL

BACKGROUND OF THE INVENTION

1. Field of the Invention

This invention relates to a multi-piece solid golf ball having a structure of at least four layers.

2. Prior Art

Golf balls of various structures are currently on the market. Among others, two-piece solid golf balls and thread-wound golf balls are commonly used in competition. The two-piece solid golf ball has a rubber based core and an enclosing cover typically of ionomer resin while the thread-wound golf ball is produced by winding thread rubber around a solid or liquid center and enclosing the center with a cover.

The two-piece solid golf balls are used by many ordinary golfers because of superior flying performance and durability although they have the drawbacks including a very hard feel upon hitting and less controllability because of quick separation from the club face upon impact. Because of these drawbacks of two-piece solid golf balls, many professional golfers and skilled amateur golfers favor wound golf balls. As compared with the two-piece solid golf balls, the wound golf balls are superior in feel and control, but inferior in carry and durability. Under the present situation that two-piece solid golf balls and wound golf balls have contradictory characteristics as mentioned above, players make a choice of golf balls depending on their own skill and taste.

Various proposals have been made for solid golf balls. Soft type two-piece solid golf balls were developed as affording a feel close to that of wound golf balls. To obtain soft type two-piece solid golf balls, soft cores must be used at the sacrifice of restitution and durability.

Such a loss of restitution leads to a loss of flight performance. Then the flight performance and durability characteristic of two-piece solid golf balls are lost to such an extent that some soft type two-piece solid golf balls are practically unacceptable.

To overcome these problems, it was proposed to interpose an intermediate layer between the solid core and the cover to form a three-piece solid golf ball of three layer structure. For the purpose of accomplishing a long carry as well as a hitting feel and controllability close to wound golf balls, Japanese Patent Publication (JP-B) No. 15 55077/1992 and Japanese Patent Application Kokai (JP-A) No. 80377/1989, for example, disclose a core in which a soft, relatively small inner layer (outer diameter: 24 to 29 mm, hardness: 15° to 30° on Shore D) is enclosed with a hard outer layer (outer diameter: 36 to 41 mm, hardness: 55° to 65° on Shore D). Also for the purpose of improving the hitting feel at no sacrifice of superior flying performance and durability characteristic of solid golf balls, JP-A 24084/1995 discloses the provision of a soft intermediate layer between the center core and the cover or outermost layer of the ball. The three-piece solid golf balls of these patents, however, fail to give a soft pleasant feel upon shots with any club ranging from a driver to a putter, at no sacrifice of superior flying performance and durability characteristic of two-piece solid golf balls Most three-piece solid golf balls are targeted to golfers who swing at high head speeds in excess of 45 m/sec., that is, average to advanced players. Thus players who swing at high head speeds can take the advantages of increased flight distance and good feel. However, when players who swing at low head speeds, such as beginner, female and senior players use the same golf balls, they can not always obtain the advantages of increased flight distance and good feel. This is because a weaker force applied to the ball upon impact causes less deformation of the ball and the flight distance becomes more dependent on the head speed. As the number of golf players, especially female and senior players increases, diversified demands are imposed on golf balls with respect to their playability factors including flight performance, feel, controllability and durability. It is desired to have a golf ball which complies with the ability and favor of individual players and is less dependent on head speed.

Therefore, an object of the invention is to provide a novel and improved multi-piece solid golf ball of high quality and performance which travels a longer distance in a wide head speed range from low to high head speeds and gives a soft pleasant hitting feel upon shots with any club ranging from a driver to a putter.

SUMMARY OF THE INVENTION

In connection with a multi-piece solid golf ball comprising a multiple solid core including an inner sphere and at least one layer surrounding the inner sphere and a cover consisting of an inner cover layer enclosing the core and an outer cover layer enclosing the inner cover layer, the inventors have made several modifications. (1) The inner sphere is made soft to have a hardness corresponding to a distortion of 3.5 to 10 mm under a load of 100 kg. Then the hitting feel obtained with a driver is improved. The flight distance is increased even at low head speeds. (2) The surrounding layer is made hardest among the ball layers as to have a Shore D hardness of at least 60. The hard surrounding layer retains the resilience of the soft core. (3) The inner cover layer is made to a Shore D hardness of up to 58. This leads to soft pleasant hitting feel, especially when putting. (4) The outer cover layer is made to a Shore D hardness of at least 60. This optimizes a spin rate upon driver shots to prevent the ball from rising sharply, ensuring an increased flight distance.

These four modifications are combined to provide an optimum structure of inner sphere, surrounding layer, inner cover layer and outer cover layer, whose flight performance is least dependent on the head speed. There is obtained an improved multi-piece solid golf ball of high quality and performance which ensures that the ball travels a longer distance when hit at any head speed in a wide range from low to high head speeds and gives a soft pleasant hitting feel upon shots with any club ranging from a driver to a putter.

Accordingly, the present invention provides a multi-piece solid golf ball comprising a multiple solid core including an inner sphere and at least one layer surrounding the inner sphere and a cover enclosing the core and consisting of inner and outer cover layers, wherein the inner sphere has a hardness expressed by a distortion of 3.5 to 10 mm under a load of 100 kg, the surrounding layer has a Shore D hardness of at least 60 which is highest among the ball layers, the inner cover layer has a Shore D hardness of up to 58, and the outer cover layer has a Shore D hardness of at least 60.

In one preferred embodiment, the inner cover layer has a gage of 0.1 to 3 mm, the outer cover layer has a gage of 0.3 to 3 mm, and the outer cover layer is harder than the cover inner layer by at least 5 on Shore D scale. Also preferably, the inner sphere is formed of a rubber base composed mainly of cis-1,4-polybutadiene and has an outer diameter of 20 to 37 mm, and the multiple solid core has a diameter of 30 to 40 mm.

DETAILED DESCRIPTION OF THE INVENTION

Figure 1:
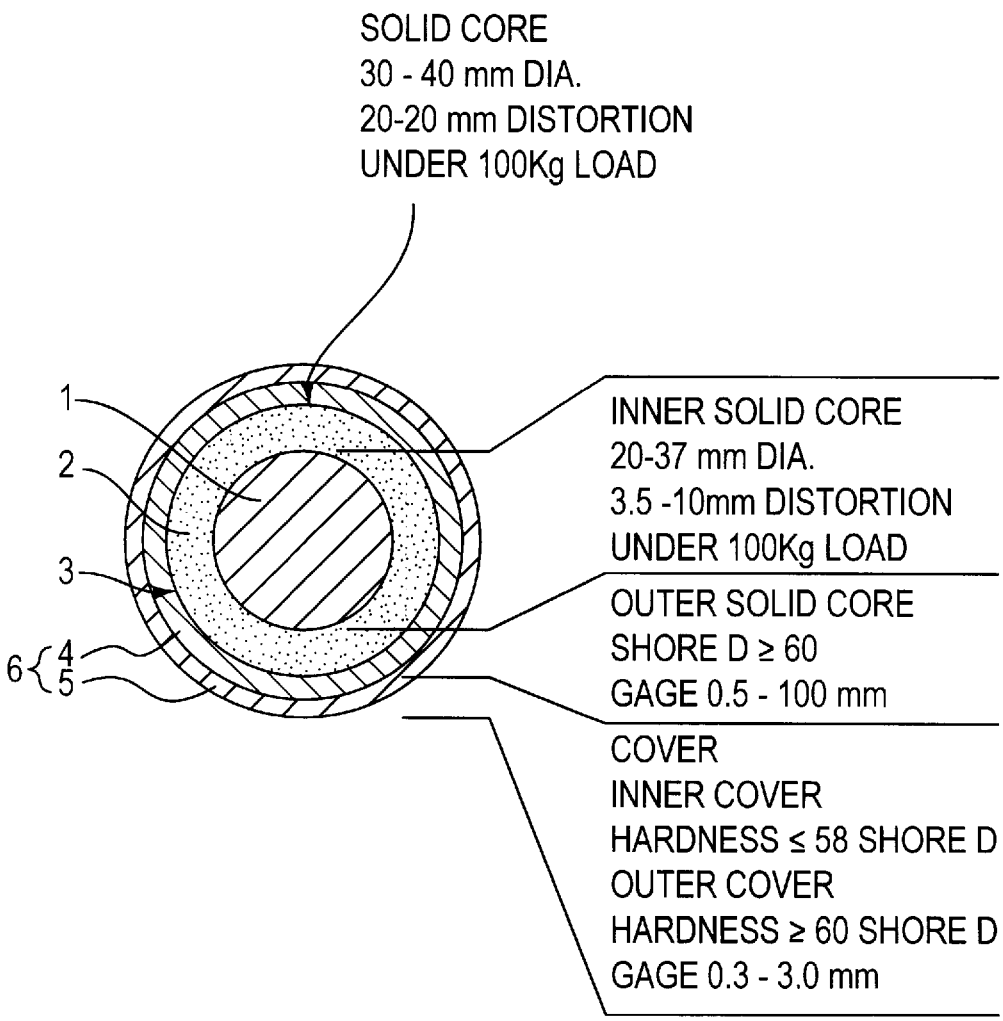
FIG. 1 is a schematic cross section of one exemplary multi-piece solid golf ball according to the invention.

Referring to FIG. 1, there is illustrated one exemplary structure of the golf ball according to the invention. The ball generally designated at 1 includes a multiple solid core 3 consisting of an inner sphere 1 and a layer 2 surrounding the inner sphere and a cover 6 around the core consisting of inner and outer cover layers 4 and 5.

Broadly, the multiple solid core 3 includes the inner sphere 1 and the layer 2 surrounding the inner sphere while the surrounding layer 2 may be a single layer or have a plurality of concentric strata. Where the surrounding layer is a single layer, the golf ball is a four-piece solid golf ball consisting of four layers. Where the surrounding layer is a two stratum layer, there results a five-piece solid golf ball consisting of five layers. The multiple solid core 3 preferably has a diameter of 30 to 40 mm, more preferably 32.5 to 39.5 mm. The core 3 as a whole preferably has a hardness expressed by a distortion of 2.0 to 7.0 mm, more preferably 2.5 to 6.0 mm under a load of 100 kg.

Like the solid core of prior art two-piece solid golf balls, the inner sphere 1 may be formed of a rubber base composed mainly of cis-1,4-polybutadiene. More particularly, the rubber base is blended with well-known additives such as a crosslinking agent, co-crosslinking agent and inert filler and molded by conventional methods.

The inner sphere 1 should be formed to a hardness expressed by a distortion of 3.5 to 10 mm, preferably 4.0 to 9.0 mm under a load of 100 kg. A sphere with a distortion of less than 3.5 mm would be too hard to give good feeling whereas a sphere with a distortion of more than 10 mm would be too soft to provide satisfactory flight performance. The diameter, weight and specific gravity of the inner sphere 1 may be properly adjusted insofar as the objects of the invention are achievable although the diameter is preferably 20 to 37 mm, especially 20 to 35.5 mm.

The surrounding layer 2 around the inner sphere 1 should be formed hardest among the ball layers in order to retain the resilience of the soft sphere 1. Specifically, the surrounding layer should have a Shore D hardness of at least 60, preferably 60 to 75. A surrounding layer with a Shore D hardness of less than 60 would be ineffective for retaining the resilience of the soft sphere 1, failing to achieve the improved flight performance. The gage and specific gravity of the surrounding layer 2 may be properly adjusted insofar as the objects of the invention are achievable although the gage (radial thickness) is preferably 0.5 to 10.0 mm, especially 1.0 to 8.0 mm.

The surrounding layer 2 may be formed of a rubber composition as used in the preparation of the inner sphere 1. Usually, the rubber composition contains a rubber base, a crosslinking agent, a co-crosslinking agent, an inert filler, and optional additives. The crosslinking agent is typically selected from organic peroxides such as dicumyl peroxide and di-tert-butyl peroxide, especially dicumyl peroxide. For example, about 0.5 to 1.5 parts by weight of the crosslinking agent is blended in 100 parts by weight of the rubber base. The co-crosslinking agent is typically selected from metal salts of unsaturated fatty acids, inter alia, zinc and magnesium salts of unsaturated fatty acids having 3 to 8 carbon atoms (e.g., acrylic acid and methacrylic acid) though not limited thereto. Zinc acrylate is especially preferred. About 5 to 60 parts by weight of the co-crosslinking agent is blended per 100 parts by weight of the base rubber. Examples of the inert filler include zinc oxide and barium sulfate. The amount of the filler blended varies with the specific gravity of core and cover, the weight of ball and other factors although the filler amount is preferably up to about 100 parts by weight per 100 parts by weight of the base rubber. In the practice of the invention, the amounts of the crosslinking agent and filler (typically zinc oxide and barium sulfate) are properly selected so as to provide the desired hardness to the surrounding layer.

Alternatively, the surrounding layer 2 is formed mainly of well-known thermoplastic resins such as ionomer resins.

For example, commercially available ionomer resins such as Himilan 1605, 1706, AM7317 and AM7318 (Mitsui-duPont Polychemical K.K.) may be used alone or in admixture of two or more.

Either of the above-mentioned materials is molded over the inner sphere 1 as by compression molding or injection molding to form the surrounding layer, completing the multiple solid core 3. Where the surrounding layer consists of two or more strata, the multiple solid core can be similarly formed.

The cover 6 enclosing the multiple solid core 3 consists of two layers, inner and outer layers 4 and 5. The inner cover layer 4 should have a Shore D hardness of up to 58, preferably 30 to 55. An inner cover layer with a Shore D hardness of more than 58 would be too hard, exacerbating the hitting feel on putting. The outer cover layer 5 should have a Shore D hardness of at least 60, preferably 60 to 70. An outer cover layer with a Shore D hardness of less than 60 would be too soft to reduce a spin rate upon driver shots, failing to extend a distance. Preferably the Shore D hardness of the outer cover layer is hither than the Shore D hardness of the inner cover layer by at least 5, especially 5 to 30.

Preferably the inner cover layer 4 has a gage (radial thickness) of 0.3 to 3 mm, especially 0.5 to 2.5 mm and the outer cover layer 5 has a gage of 0.1 to 3 mm, especially 0.3 to 2.5 mm. The overall cover gage, that is, the total gage of the inner and outer layers combined is usually about 1.0 to 6.0 mm.

The materials of which the inner and outer cover layers 4 and 5 are made are not critical. The layers may be formed to the desired hardness by selecting suitable ones of thermoplastic resins including ionomer resins and non-ionomer resins. For the inner cover layer, a choice may be made among commercially available thermoplastic elastomers such as Hytrel 4047, 4767 and 5557 (Toray-duPont K.K.). For the outer cover layer, a choice may be made among commercially available ionomer resins such as Himilan 1605, 1706, AM7317, AM7318, 1601, 1557 and 1856 (Mitsui-duPont Polychemical K.K.) and Surlyn 8120 (E. I. duPont). These resins may be used alone or in admixture of two or more. Of course, various additives are added to the cover stock if desired. For example, pigments, dispersants, antioxidants, UV absorbers, and mold release agents are added in commonly used amounts.

The solid core can be enclosed with the inner and outer cover layers by any desired method, for example, by successively injection molding cover stocks over the core or by preforming a pair of hemispherical half cups from a cover stock, encasing the core with the half cups and effecting heat compression molding.

Like conventional golf balls, the golf ball of the invention is formed with a multiplicity of dimples in the cover surface. The ball surface is further subject to finishing steps including buffing, painting and stamping.

The golf ball of the invention is prepared in accordance with the Rules of Golf, that is, to a diameter of not less than 42.67 mm and a weight of not greater than 45.93 grams.

There has been described a multi-piece solid golf ball which offers a soft pleasant hitting feel upon shots with any club varying from a driver to a putter. The ball offers a satisfactory flight distance and feel to a wide spectrum of players covering players who swing at medium to high head speeds and players who swing at low head speeds, especially those players who swing at a head speed of about 35 m/sec. The flight performance of the ball is less dependent on head speed. Over a wide spectrum of head speed, the ball ensures the advantage of an increased flight distance.

EXAMPLE

Examples of the present invention are given below by way of illustration and not by way of limitation.

Examples 1—5 & Comparative Examples 1–4

Golf balls were prepared by the following procedure.

It is noted that Hytrel is a trade name of thermoplastic polyester elastomer by Toray-duPont K.K.; Himilan is a trade name of ionomer resin by Mitsui-duPont Polychemical K.K.; and Surlyn is a trade name of ionomer resin by E. I. dupont.

Inner spheres of Examples 1 to 5 and Comparative Examples 1 to 4 having a diameter and hardness as shown in Table 3 were prepared by milling an inner sphere-forming rubber composition of the formulation shown in Tables 1 and 2 in a roll mill and molding and vulcanizing it in a mold at 155° C. for 15 minutes.

In Examples 1 to 5 and Comparative Example 3, a surrounding layer of the composition shown in Tables 1 and 2 was molded over the inner sphere to form a multiple solid core. Where the surrounding layer-forming composition was a rubber stock, a multiple solid core was prepared by milling the indicated components in a roll mill, molding the compound into partially vulcanized half shells, enclosing the inner sphere with the half shells, and heat compression molding at 155° C. for 15 minutes. Where the surrounding layer-forming composition was a thermoplastic stock, a multiple solid core was prepared by blending Himilan 1606 and 1706 or Himilan AM7317 and AM7318 in a weight ratio of 50/50 and injection molding the blend over the inner sphere.

Next, inner and outer cover stocks of the composition shown in Tables 1 and 2 were successively injection molded over the inner sphere or multiple solid core to complete a two, three or four-piece golf ball. Examples 1 to 5 were four-piece golf balls. Comparative Examples 1 and 2 were two-piece golf balls free of a surrounding layer and having one cover layer. Comparative Example 3 was a three-piece golf ball having a surrounding layer and one cover layer. Comparative Example 4 was a three-piece golf ball free of a surrounding layer and having two cover layers.

TABLE 1

| Ball structure | | | | E1 4 layer | E2 4 layer | E3 4 layer | E4 4 layer | E5 4 layer |
|---|---|---|---|---|---|---|---|---|
| Core | Inner sphere | Cis-1,4-polybutadiene | | 100 | 100 | 100 | 100 | 100 |
| | | Zinc acrylate | | 22.0 | 18.0 | 18.0 | 8.0 | 22.0 |
| | | Dicumyl peroxide | | 0.9 | 0.9 | 0.9 | 0.9 | 0.9 |
| | | Antioxidant | | 0.2 | 0.2 | 0.2 | 0.2 | 0.2 |
| | | Zinc oxide | | 5.0 | 5.0 | 5.0 | 5.0 | 5.0 |
| | | Barium sulfate | | 33.3 | 47.7 | 27.7 | 28.6 | 17.3 |
| | Surrounding layer | Thermoplastic stock | Himilan 1605 | 50 | — | — | — | — |
| | | | Himilan 1706 | 50 | — | — | — | — |
| | | | Himilan AM7317 | — | 50 | 50 | — | — |
| | | | Himilan AM7318 | — | 50 | 50 | — | — |
| | | Rubber stock | Cis-1,4-polybutadiene | — | — | — | 100 | 100 |
| | | | Zinc acrylate | — | — | — | 52.0 | 52.0 |
| | | | Dicumyl peroxide | — | — | — | 0.9 | 0.9 |
| | | | Antioxidant | — | — | — | 0.2 | 0.2 |
| | | | Zinc oxide | — | — | — | 5.0 | 5.0 |
| | | | Barium sulfate | — | — | — | 9.7 | 3.8 |
| Cover | Inner layer | Hytrel 4047 | | 100 | — | — | — | — |
| | | Hytrel 4767 | | — | 100 | — | 100 | — |
| | | Hytrel 5557 | | — | — | 100 | — | 100 |
| | Outer layer | Himilan 1605 | | — | — | 50 | 30 | 30 |
| | | Himilan 1706 | | — | — | 50 | — | — |
| | | Himilan 1601 | | 50 | 50 | — | — | — |
| | | Himilan 1557 | | 50 | 50 | — | 50 | 50 |
| | | Himilan 1856 | | — | — | — | 20 | 20 |
| | | Surlyn 8120 | | — | — | — | — | — |

TABLE 2

| Ball structure | | | CE1 2-piece | CE2 2-piece | CE3 3-piece | CE4 3-piece |
|---|---|---|---|---|---|---|
| Core | Inner sphere | Cis-1,4-polybutadiene | 100 | 100 | 100 | 100 |
| | | Zinc acrylate | 18.0 | 33.0 | 13.0 | 31.5 |
| | | Dicumyl peroxide | 0.9 | 0.9 | 0.9 | 0.9 |
| | | Antioxidant | 0.2 | 0.2 | 0.2 | 0.2 |

TABLE 2-continued

| Ball structure | | | | CE1 2-piece | CE2 2-piece | CE3 3-piece | CE4 3-piece |
|---|---|---|---|---|---|---|---|
| | | Zinc oxide | | 5.0 | 5.0 | 5.0 | 5.0 |
| | | Barium sulfate | | 24.3 | 17.8 | 26.4 | 18.5 |
| | Surrounding layer | Thermoplastic stock | Himilan 1605 | — | — | — | — |
| | | | Himilan 1706 | — | — | — | — |
| | | | Himilan AM7317 | — | — | — | — |
| | | | Himilan AM7318 | — | — | — | — |
| | | Rubber stock | Cis-1,4-polybutadiene | — | — | 100 | — |
| | | | Zinc acrylate | — | — | 46.0 | — |
| | | | Dicumyl peroxide | — | — | 0.9 | — |
| | | | Antioxidant | — | — | 0.2 | — |
| | | | Zinc oxide | — | — | 5.0 | — |
| | | | Barium sulfate | — | — | 12.2 | — |
| Cover | Inner layer | Hytrel 4047 | | — | — | — | 100 |
| | | Hytrel 4767 | | — | — | — | — |
| | | Hytrel 5557 | | — | — | — | — |
| | Outer layer | Himilan 1605 | | 50 | — | 50 | 50 |
| | | Himilan 1706 | | 50 | — | 50 | 50 |
| | | Himilan 1601 | | — | — | — | — |
| | | Himilan 1557 | | — | — | — | — |
| | | Himilan 1856 | | — | — | — | — |
| | | Surlyn 8120 | | — | 100 | — | — |

The golf balls were examined by the following tests.

Inner sphere hardness

A load of 100 kg was applied to the inner sphere to measure a distortion (mm).

Flyinq Performance

Using a swing robot, the ball was hit with a driver (#W1) at a head speed of 45 m/sec. (HS45) and 35 m/sec. (HS35) to measure a spin rate, carry and total distance.

Hitting feel

A panel of golfers examined the ball for hitting feel by actually hitting the ball with a driver (#W1). The panel included three professional golfers with a head speed of about 45 m/sec. The other panel included three top amateur female golfers with a head speed of about 35 m/sec. A similar test was repeated using a putter. The ball was rated "◎", for very soft feel, "O" for soft feel, "Δ" for somewhat hard feel, and "X" for hard feel.

The results are shown in Table 3.

TABLE 3

| Ball structure | | | E1 4 layer | E2 4 layer | E3 4 layer | E4 4 layer | E5 4 layer | CE1 2-piece | CE2 2-piece | CE3 3-piece | CE4 3-piece |
|---|---|---|---|---|---|---|---|---|---|---|---|
| Inner sphere | | Diameter (mm) | 32.7 | 30.0 | 33.8 | 20.0 | 35.0 | 38.7 | 38.7 | 25.0 | 35.3 |
| | | Hardness (mm) | 5.0 | 6.0 | 6.0 | 9.0 | 5.0 | 6.0 | 3.0 | 7.5 | 3.3 |
| Surrounding layer | | Shore D hardness | 65 | 68 | 68 | 62 | 62 | — | — | 60 | — |
| Core | | Diameter (mm) | 35.7 | 35.7 | 36.7 | 34.7 | 38.3 | — | — | 38.7 | — |
| Cover | Inner layer | Gage (mm) | 1.5 | 1.5 | 1.8 | 2.0 | 1.0 | — | — | — | 1.7 |
| | | Shore D hardness | 40 | 47 | 55 | 47 | 40 | — | — | — | 40 |
| | Outer layer | Gage (mm) | 2.0 | 2.0 | 1.2 | 2.0 | 1.2 | 2.0 | 2.0 | 2.0 | 2.0 |
| | | Shore D hardness | 62 | 62 | 65 | 61 | 61 | 65 | 47 | 65 | 65 |
| #W1/HS4S | | Spin (rpm) | 2340 | 2200 | 2220 | 2290 | 2430 | 2020 | 2890 | 2110 | 2640 |
| | | Carry (m) | 211.8 | 211.3 | 210.6 | 211.3 | 212.0 | 206.1 | 209.5 | 207.7 | 210.2 |
| | | Total (m) | 226.5 | 226.3 | 225.5 | 225.7 | 226.5 | 220.4 | 223.1 | 221.8 | 224.1 |
| | | Feel | ◎ | ◎ | ◎ | ◎ | ◎ | ◎ | Δ | ◎ | Δ |
| #W1/HS35 | | Spin (rpm) | 4170 | 4010 | 4050 | 4130 | 4230 | 3890 | 4520 | 3960 | 4400 |
| | | Carry (m) | 144.1 | 144.3 | 143.2 | 143.8 | 144.2 | 139.5 | 141.2 | 141.5 | 142.4 |
| | | Total (m) | 156.6 | 156.7 | 155.8 | 156.0 | 156.7 | 151.7 | 152.6 | 153.0 | 154.2 |
| | | Feel | ◎ | ◎ | ◎ | ◎ | ◎ | ◎ | X | ○ | X |
| Putter | | Feel | ◎ | ◎ | ◎ | ◎ | ◎ | Δ | ◎ | X | ◎ |

As is evident from Table 3, multi-piece solid golf balls of the four layer structure within the scope of the invention travel a longer distance independent of whether the clubhead speed is high (HS45) or low (HS35) and present a very soft pleasant feel independent of whether the club is either a driver or a putter.

Japanese Patent Application No. 143735/1996 is incorporated herein by reference.

Although some preferred embodiments have been described, many modifications and variations may be made thereto in the light of the above teachings. It is therefore to be understood that within the scope of the appended claims, the invention may be practiced otherwise than as specifically described.

We claim:

1. A multi-piece solid golf ball comprising a multiple solid core including an inner sphere and at least one layer surrounding the inner sphere and a cover enclosing the core and consisting of inner and outer cover layers, wherein said inner sphere has a hardness expressed by a distortion of 3.5 to 10 mm under a load of 100 kg, said surrounding layer has a Shore D hardness of at least 60 which is highest among the ball layers, said inner cover layer has a Shore D hardness of up to 58, and said outer cover layer has a Shore D hardness of at least 60.

2. The multi-piece solid golf ball of claim 1 wherein the inner cover layer has a gage of 0.1 to 3 mm, the outer cover layer has a gage of 0.3 to 3 mm, and the outer cover layer is harder than the cover inner layer by at least 5 on Shore D.

3. The multi-piece solid golf ball of claim 1 wherein said inner sphere is formed of a rubber base composed mainly of cis-1,4-polybutadiene and has an outer diameter of 20 to 37 mm, and the multiple solid core has a diameter of 30 to 40 mm.

4. The multi-piece solid golf ball of claim 1, wherein said multiple solid core has a diameter in the range of 32.5 to 39.5 mm.

5. The multi-piece solid golf ball of claim 1, wherein said solid core as a whole has a distortion of 2.0 to 7.0 mm under a load of 100 kg.

6. The multi-piece solid golf ball of claim 1, wherein said inner sphere has a diameter in the range of 20–30 mm.

7. The multi-piece solid golf ball of claim 1, wherein said surrounding layer has a Shore D hardness in the range of 60 to 75.

8. The multi-piece solid golf ball of claim 1, wherein said surrounding layer has a radial thickness in the range of 0.5 to 10 mm.

9. The multi-piece solid golf ball of claim 1, wherein said inner core layer has a Shore D hardness in the range of 30 to 55.

10. The multi-piece solid golf ball of claim 1, wherein said outer cover has a Shore D hardness in the range of 60 to 70.

11. The multi-piece solid golf ball of claim 1, wherein said outer cover layer has a gage in the range of 0.3 to 2.5 mm.

12. The multi-piece solid golf ball of claim 1, wherein a total gage of said inner and outer layers is in the range of 1.0 to 6.0 mm.

* * * * *